US008801145B2

(12) United States Patent
Wakakusa

(10) Patent No.: US 8,801,145 B2
(45) Date of Patent: Aug. 12, 2014

(54) IMAGE RECORDING APPARATUS

(71) Applicant: Brother Kogyo Kabushiki Kaisha, Nagoya (JP)

(72) Inventor: Keisuke Wakakusa, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,423

(22) Filed: Mar. 28, 2013

(65) Prior Publication Data

US 2013/0257987 A1 Oct. 3, 2013

(30) Foreign Application Priority Data

Mar. 30, 2012 (JP) ..... 2012-078813

(51) Int. Cl.
*B41J 23/00* (2006.01)
*B41J 23/02* (2006.01)

(52) U.S. Cl.
CPC ..... *B41J 23/025* (2013.01)
USPC ..... 347/39

(58) Field of Classification Search
CPC ..... B41J 223/025
USPC ..... 347/39
See application file for complete search history.

(56) References Cited

U.S. PATENT DOCUMENTS

| | | | | |
|---|---|---|---|---|
| 2007/0048058 | A1 | 3/2007 | Koga et al. | |
| 2007/0048059 | A1 | 3/2007 | Asada et al. | |
| 2007/0057447 | A1 | 3/2007 | Asada et al. | |
| 2009/0035018 | A1 * | 2/2009 | Koga et al. | 399/167 |
| 2009/0035019 | A1 | 2/2009 | Koga et al. | |
| 2009/0167792 | A1 * | 7/2009 | Ogawa et al. | 347/1 |
| 2010/0157328 | A1 * | 6/2010 | Hoshino | 358/1.8 |
| 2011/0310174 | A1 * | 12/2011 | Samoto et al. | 347/37 |

FOREIGN PATENT DOCUMENTS

| | | | |
|---|---|---|---|
| JP | 2007-090761 | A | 4/2007 |
| JP | 2009-034832 | A | 2/2009 |

* cited by examiner

*Primary Examiner* — Stephen Meier
*Assistant Examiner* — Alexander D Shenderov
(74) *Attorney, Agent, or Firm* — Merchant & Gould PC

(57) ABSTRACT

A record image recording apparatus includes a carriage provided with a recording head and reciprocating in a main scanning directions; a lever member having a lever arm protruding into a moving space of the carriage; a switch member contactable with the lever member; and a guide member guiding the lever arm. When the lever member is guided by the guide member in one direction perpendicular to the main scanning directions, the lever member is switched to be applied with a force in the one direction owing to the switch member. When the lever member is guided by guide member in an opposite direction relative to the one direction, the lever member is switched to be applied with the force in the opposite direction owing to the switch member.

8 Claims, 10 Drawing Sheets

IMAGE RECORDING APPARATUS

CROSS REFERENCE TO RELATED APPLICATION

The present application claims priority from Japanese Patent Application No. 2012-078813, which was filed on Mar. 30, 2012, the disclosure of which is herein incorporated by reference in its entirety.

BACKGROUND OF THE INVENTION

1. Field of the Invention

The present invention relates to an image recording apparatus in which a recording head reciprocates together with a carriage in main scanning directions to perform an image recording, and particularly relates to an image recording apparatus in which an output of a driving motor is selectively transmitted to a plurality of driving portions.

2. Description of Related Art

An ink jet printer is known as an image recording apparatus which performs an image recording by selectively ejecting an ink from a recording head onto a recording medium in a conveyance of a recording sheet from a sheet supply tray to a sheet discharged tray. The recording sheet is supplied from the sheet supply tray to a sheet conveying path, and is conveyed in the sheet conveying path. The supply and the conveyance are carried out by that rollers, such as sheet supply rollers and conveyance rollers, are brought into contact with the recording sheet, pressed onto the recording sheet, and rotated. As a drive source for these rollers, a motor, such as a DC motor and a stepping motor, is used. A transmission of driving from the motor to the rollers is achieved by a drive transmission mechanism having a combination of a pinion gear and a timing belt.

Regarding a recording head used in the ink-jet printer, an air bubble may generate in a nozzle which ejects an ink, and a foreign matter may clog up the nozzle. These incidents cause an ejection failure of the ink. A procedure is known for a prevention for and a recover from the ejection failure of the ink. According to the procedure, the air bubble and the foreign matter will be sucked to be removed from the nozzle of the recording head. This procedure is commonly referred to as a purge. A maintenance unit for performing the purge includes a cap covering the nozzle of the recording head, a pump for decreasing a pressure in the cap, and so on. The motor is also used for driving the pump in the maintenance unit, used as a drive source for a cam for switching an exhaust valve, and so on. A transmission of driving from the motor to each of drive portions is achieved by the aforementioned drive transmission mechanism.

An image recording apparatus having a drive transmission switching device is conventionally known. The drive transmission switching device switches a transmission of a driving from the motor as the drive source to each of the drive portions. The drive transmission switching device selectively transmits the driving to each of the drive portions in accordance with a movement position of the carriage. Therefore, the single drive source can transmit the driving, for example, to the conveyance roller in the image recording and to the maintenance unit in the purge.

SUMMARY OF THE INVENTION

In the drive transmission switching device configured like this, for example, a lever in contact with the carriage is selectively positioned in any of a plurality of guide positions in a carriage movement directions. Since the lever arm is selectively positioned in each of the guide positions, a destination of the drive transmission from the motor is changed. In addition, when the lever arm returns from one of the guide positions to another of the guide positions, the lever arm is required to surely return to said another guide position without being locked at the other guide positions other than the one guide position and said another guide position.

It is an object of the present invention to provide an apparatus in which a lever member having a lever arm for switching a drive transmission from a motor smoothly and surely slides to a desired position.

The object indicated above may be achieved according to the present invention which provides a record image recording apparatus including: a carriage on which a recording head is mounted, configured to reciprocate in a main scanning directions; a first gear configured to rotate around a rotation axis of the first gear extending along the main scanning directions on the basis of an output of a driving motor; a second gear meshed with the first gear and slidably supported by a support shaft extending along the main scanning directions, the second gear being movable at a plurality of slide positions; a plurality of transmission gears arranged in parallel, each of which is meshable with the second gear at a corresponding one of the plurality of slide positions of the second gear; a lever member slidably supported by the support shaft and pivotably supported around the support shaft, the lever member being disposed in one of opposite side regions of the second gear in a first direction which is one direction of the main scanning directions, the lever member comprising a lever arm protruding into a moving space through which the carriage moves; a switch member slidably supported by the support shaft and disposed in the one of the opposite side regions in which the lever member is disposed, the switch member having a first inclined portion and a second inclined portion each contactable with a contact portion of the lever member; a first force applying portion configured to apply a force in the first direction to the second gear such that the force is applied from the second gear to the lever member; a second force applying portion configured to apply a force larger than the force applied by the first force applying portion to the switch member, in a second direction which is opposite to the first direction so that the switch member comes into abutting contact with the lever member; a first guide member configured to guide the lever arm while the lever arm slides on the first guide member in the main scanning directions, and configured to position the lever arm at selectively one of a plurality of slide positions of the lever arm, the plurality of slide positions of the lever arm corresponding to the respective positions of the plurality of transmission gears; and a second guide member configured to restrict a circumferential rotation of the switch member with respect to the support shaft, wherein the first guide member is provided with a plurality of peripheries including a first periphery and a second periphery each extending along the main scanning directions, the plurality of peripheries defining a long hole through which the lever arm is inserted, wherein the first periphery is provided with: a plurality of lock portions which lock the lever arm to which the force in the second direction is applied; and a third inclined portion which causes the lever arm to pivot in a direction in which the lever arm comes close to the second periphery, wherein the third inclined portion is positioned at a part of the first periphery nearer to the second force applying portion than the lock portions in the main scanning directions, wherein the second periphery is provided with a fourth inclined portion which causes the lever arm to pivot in a direction in which the lever arm comes close to the first periphery, wherein the fourth inclined portion is positioned at a part of the second periphery opposing to one of the plurality of lock portions nearest to the first force applying portion in the main scanning directions, wherein the lever member is guided by the third inclined portion in the direction in which the lever arm comes close to the second periphery so that a contact position of the switch member in contact with a contact portion of the lever member moves from on the first inclined portion to on the second inclined portion, whereby the switch member is configured to cause a switch from a state in which the lever member is applied with a force from the switch member in the direction in which the lever arm comes close to the first periphery to a state in which the lever member is applied with a force from the switch member in the direction in which the lever arm comes close to the second periphery, and wherein the lever member is guided by the fourth inclined portion in the direction in which the lever arm comes close to the first periphery so that the contact position of the switch member in contact with the contact portion of the lever member moves from on the second inclined portion to on the first inclined portion, whereby the switch member is configured to cause a switch from a state in which the lever member is applied with the force from the switch member in the direction in which the lever arm comes close to the second periphery to a state in which the lever member is applied with the force from the switch member in the direction in which the lever arm comes close to the first periphery.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE PREFERRED EMBODIMENTS

An embodiment according to the present invention is described in the following with appropriate reference to the figures. The embodiment described below is just an example in which the present invention is embodied. It should be understood that the embodiment may be modified and varied within the subject matter of the present invention. It is noted that, in a following description, a term "direction" is referred to as a one-way course in which something moves only from one point to another point, and a term "directions" is referred to as a both-way course in which something moves from one point to another point and moves from the another point to the one point.

General Structure of Printer 10

Figure 1:
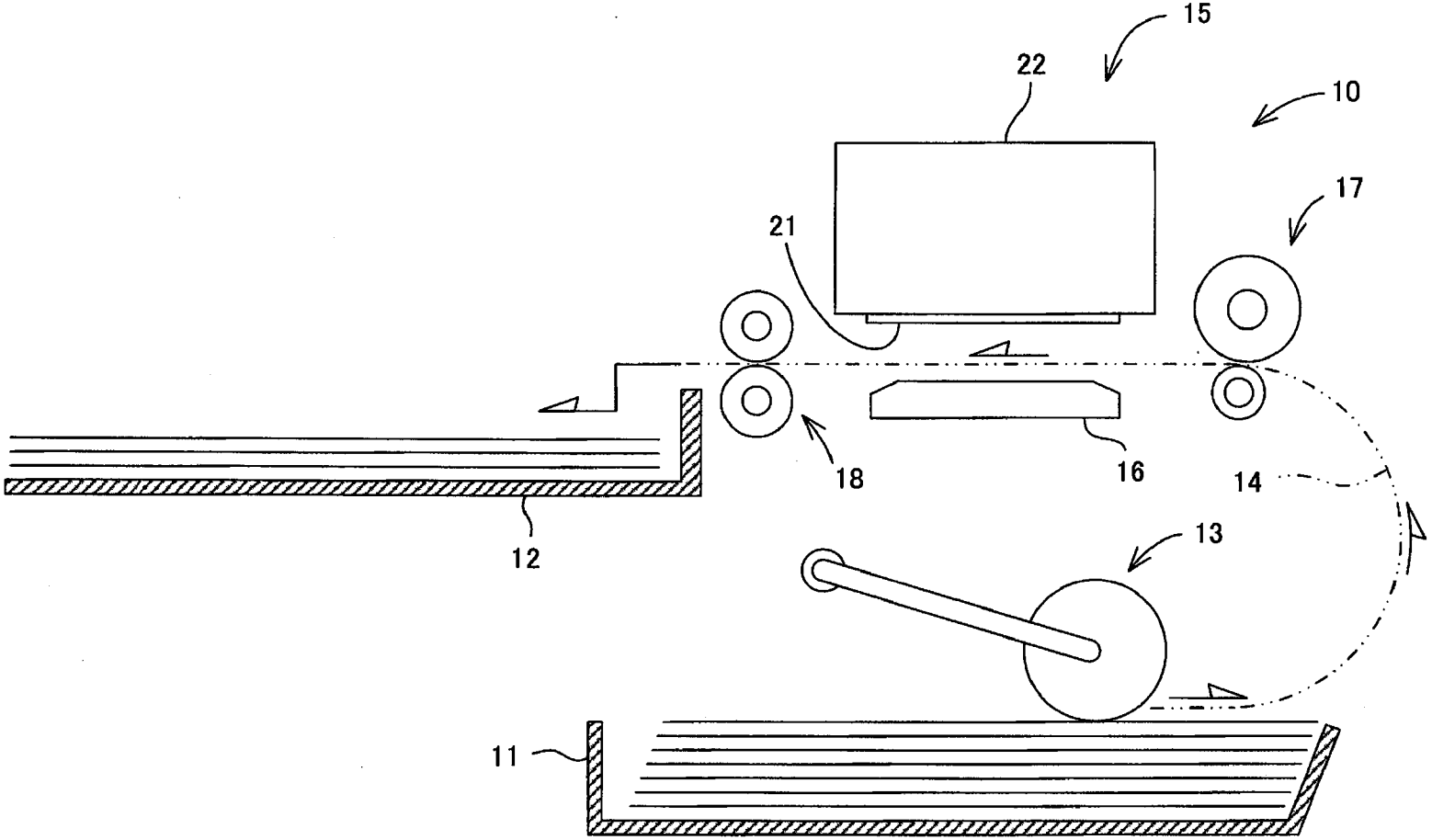
FIG. 1 is a cross-sectional view schematically showing an internal structure of a printer 10 as one embodiment according to the present invention.

As shown in FIG. 1, a printer 10 is commonly connected to an external device such as a computer. The printer 10 records an image and a document on a recording medium on the basis of printer data containing image data and document data transmitted from the external device. In addition, the printer 10 is capable of being loaded with a variety of memory media, such as a memory card, so as to record an image and so on of data stored in the memory medium, on the recording medium. It is noted that the recording media used in the printer 10 is, for example, a paper sheet or a plastic sheet.

The printer 10 includes a sheet supply tray 11 and a sheet discharged tray 12 which are arranged in a lower side and an upper side of the printer 10, respectively. The sheet supply tray 11 is disposed below the sheet discharged tray 12, and accommodates recording sheets as the recording medium. A size of the recording sheets allowed to be accommodated in the sheet supply tray 11 is a predetermined size, such as an A4 size, a B5 size, and a post card size which are smaller than a legal size. The recording sheet accommodated in the sheet supply tray 11 is supplied by a sheet supply roller 13 to a conveying path 14, then a desired image is recorded on the recording sheet by the recording device 15, and finally the recording sheet is discharged to the sheet discharged tray 12.

The conveying path 14 extends upward from a right edge (right end in FIG. 1) of the sheet supply tray 11, curves toward a front side of the printer 10, then passes through the recording device 15, and finally leads to the sheet discharged tray 12. Accordingly, the recording sheet accommodated in the sheet supply tray 11 is guided by the conveying path 14 so as to move from the lower side of the printer 10 to the upper side of the printer 10, like perform a U-turn, then reach to the recording device 15, have an image by the recording device 15, and finally exit to the sheet discharged tray 12.

The recording device 15 is disposed at a downstream side of a curved portion of the conveying path 14 in a sheet conveyed direction in which the recording sheet is conveyed. The recording device 15 has a carriage 22 which is provided with a recording head 21 and reciprocates together with the recording head 21. The recording head 21 is supplied with inks of cyan (C), magenta (M), yellow (Y), and black (Bk) colors from ink cartridges through ink tubes 20 (refer to FIG. 2). The ink cartridges are disposed in the printer 10 independently from the recording head 21. While the carriage 22 reciprocates, each of the inks of respective colors is selectively ejected in a form of a tiny ink droplet, whereby an image is recorded on the recording sheet conveyed on a platen 16. A structure of the recording device 15 is described later in detail.

Conveyor roller pairs 17, 18 are provided in an upstream side and a downstream side of the recording device 15 in the sheet conveyed direction, respectively. The conveyor roller pairs 17, 18 nip and convey the recording sheet conveyed through the conveying path 14. One roller of each of the conveyor roller pairs 17, 18 is driven by a motor not shown in the figures so as to be rotated. The other roller of each of the conveyor roller pairs 17, 18 is driven by the one roller driven by the motor.

Recording Device 15

Figure 2:
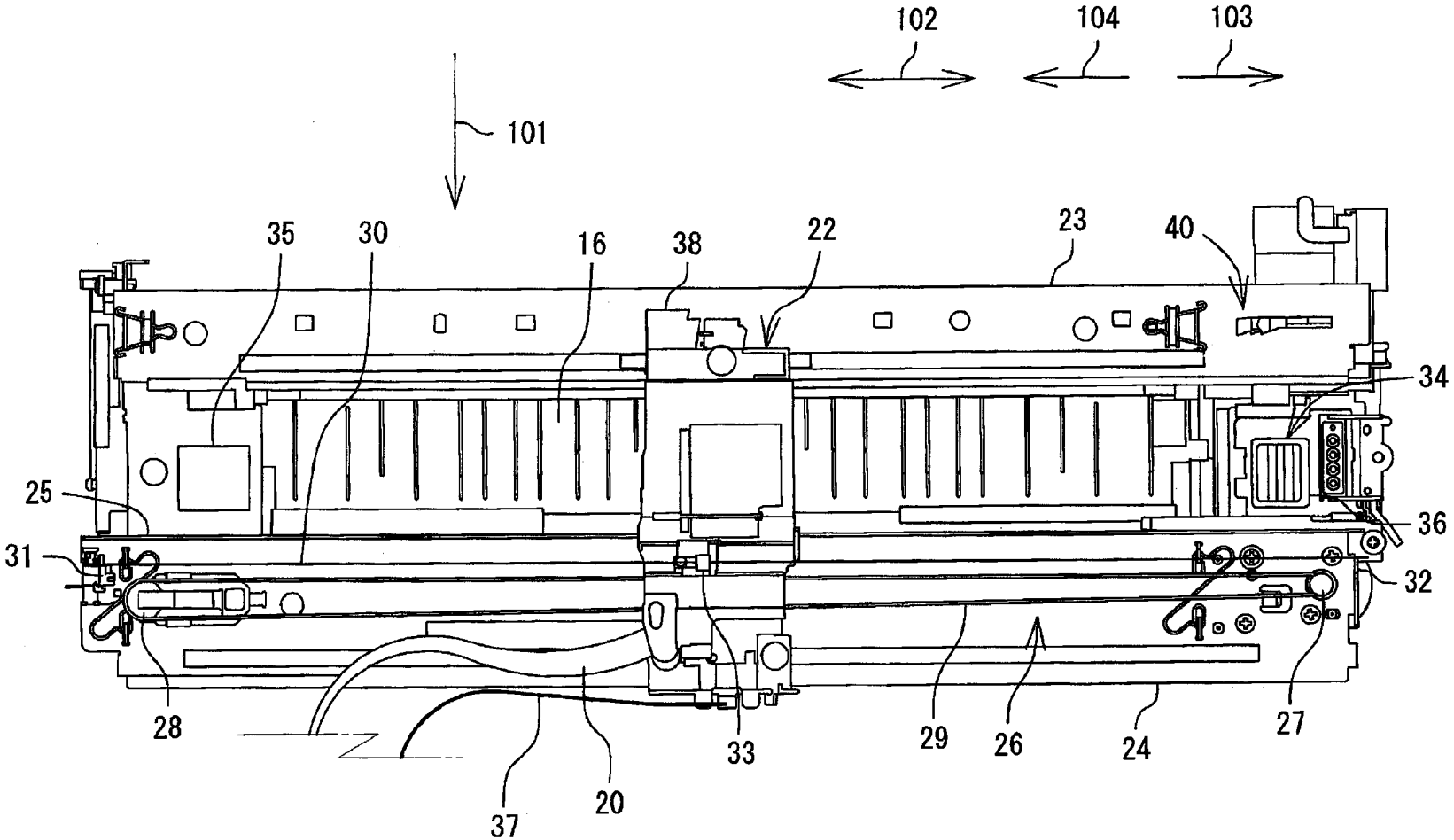
FIG. 2 is a plain view showing a constitution of a recording device 15.

As shown in FIG. 2, a pair of guide rails 23, 24 are disposed above the conveying path 14 with a predetermined distance provided between the guide rails 23, 24 in a sheet conveyed direction 101 (a direction from an upper side to a lower side on a drawing sheet of FIG. 2) in which the recording sheet is conveyed. And the guide rails 23, 24 extend in a main scanning directions (left-right directions on a drawing sheet of FIG. 2) 102 perpendicular to the sheet conveyed direction 101. The guide rails 23, 24 are provided within a housing of the printer 10, and thus constitute a part of a frame supporting each of members constituting the printer 10. The carriage 22 is disposed on the guide rails 23, 24 so as to bridge a space between the guide rails 23, 24, and is slidable on the guide rails 23, 24 in the main scanning directions 102.

The guide rail 23 is disposed in an upstream side of the guide rail 24 in the sheet conveyed direction 101. The guide rail 23 has a length longer than a range of a reciprocation of the carriage 22, in width directions of the conveying path 14 (the left-right directions on a drawing sheet of FIG. 2). The guide rail 24 is disposed in a downstream side of the guide rail 23 in the sheet conveyed direction 101. The guide rail 24 is shaped like a flat plate having a length equal to the length of the guide rail 23, in the width directions of the conveying path 14. An upstream side edge of the carriage 22 in the sheet conveyed direction 101 is positioned on the guide rail 23 and a downstream side edge of the carriage 22 in the sheet conveyed direction 101 is positioned on the guide rail 24, whereby the carriage 22 slides along a longitudinal directions of the guide rails 23, 24. An upstream side edge portion 25 of the guide rail 24 in the sheet conveyed direction 101 is bent toward an upper side of the printer 10 at an approximately right angle. The carriage 22 carried and supported by the guide rails 23, 24 slidably pinches the edge portion 25 with a pinch member such as a roller pair. Therefore, the carriage 22 is positioned relative to the sheet conveyed direction 101 and is slidable in the main scanning directions 102.

A belt driving mechanism 26 is disposed on an upper surface of the guide rail 24. The belt driving mechanism 26 is constructed such that a belt 29 being a loop-like endless belt provided with teeth inside the belt, is tightly wound around a drive pulley 27 and a passive pulley 28 which are provided at around respective ends of the conveying path 14 in the width directions thereof A drive force is input from a motor not shown in the figures to a shaft of the drive pulley 27, and a rotation of the drive pulley 27 causes a rotational motion of the belt 29. Incidentally, the belt 29 is not limited to a loop-like endless belt, and may be a belt having both ends which are fastened to the carriage 22.

The carriage 22 is fastened to the belt 29 at a bottom face side of the carriage 22. Accordingly, the carriage 22 reciprocates with reference to the edge portion 25 on the guide rails 23, 24 in the main scanning directions 102, on the basis of the rotational motion of the belt 29 caused by the motor. The recording head 21 is mounted on the carriage 22, and reciprocates with the carriage 22 in the main scanning directions 102.

The guide rail 23 is provided with an encoder strip 30 as a linear encoder. The encoder strip 30 is a strip-like object made of a transparent plastic. Support portions 31, 32 are formed as a pair at respective both ends of the guide rail 23 in width directions thereof (the main scanning directions 102), in such a manner as to raise from a top surface of the guide rail 23. The encoder strip 30 is held by the support portions 31, 32 at both ends of the encoder strip 30, thereby being provided between the support portions 31, 32.

The encoder strip 30 has a pattern thereon in which a transparent sections and opaque sections are alternately arranged at constant intervals. The transparent sections are sections through which a light passes, and opaque sections are sections by which the light is blocked. An optical sensor 33 being a light transmissive sensor is provided at a position being on a top face of the carriage 22 and corresponding to the encoder strip 30. The optical sensor 33 reciprocates together with the carriage 22 in a longitudinal direction of the encoder strip 30, and detects the pattern of the encoder strip 30 in the reciprocation. The recording head 21 is provided with a head control substrate which controls the ejection of the inks. The head control substrate outputs a pulse signal based on a detection signal of the optical sensor 33, and determines a position of the carriage 22 on the basis of the pulse signal, whereby the driving of the motor is controlled. It is noted that the head control substrate mounted on the carriage 22 is covered and is not depicted in FIG. 2.

As shown in FIG. 1 and FIG. 2, the platen 16 is disposed below the conveying path 14 in such a manner as to face to the recording head 21. The platen 16 is disposed at a center section of the range of the reciprocation of the carriage 22 in the main scanning directions. The center section is a section covering a space through which the recording sheet passes. The platen 16 is wider than a maximum width of the recording sheet which can be conveyed in the printer 10. Therefore, both edges of the recording sheet in width directions thereof always pass over the platen 16 when the recording sheet is conveyed through the conveying path 14.

As shown in FIG. 2, a purge mechanism 34 is disposed at one of opposite edges of the platen 16 in width directions thereof, and a waste ink tray 35 is disposed at the other of opposite edges of the platen 16. The purge mechanism 34 is configured to suck an air bubble and a foreign matter so as to remove them from a nozzle of the recording head 21. The purge mechanism 34 has a cap 36 which covers the nozzle of the recording head 21. The cap 36 is moved upward and downward by a known lift-up mechanism, whereby the cap 36 moves close to and away from the recording head 21. Not shown in FIG. 2, the purge mechanism 34 further has a suction pump. The suction pump is communicated with the cap 36, and thus an inside of the cap 36 is brought into a negative pressure. When the suction pump is activated in a state in which the cap 36 is in contact with the recording head 21 while covering the nozzle and an exhaust port, the air bubble and the foreign matter is sucked to be removed from the recording head 21.

The waste ink tray 35 is configured to receive the ejections of the inks from the recording head 21 while the inks are not used for a printing. This ejection is referred to as a flushing. Inside the waste ink tray 35, a felt is laid as an ink absorption member. Therefore, the inks ejected in the flushing are absorbed and held by the felt. Each of the purge mechanism 34 and the waste ink tray 35 is used for a maintenance, such as a removal of the air bubble and the mixed color inks, and a protection of dry-up, within the recording head 21.

Not shown in the figures, the printer 10 is provided with a cartridge mount portion, in which the ink cartridges storing the inks of the respective colors is mounted. The plurality of ink tubes 20 each corresponding to each of the inks of respective colors are provided from the cartridge mount portion to the carriage 22. The inks of the respective colors are supplied, through the ink tubes 20, from the ink cartridges mounted on the cartridge mount portion to the recording head 21 mounted on the carriage 22. Each of the ink tubes 20 is a tube made of a synthetic resin and has flexibility which allows the ink tubes 20 to bend according to the reciprocation of the carriage 22.

A recording signal is transmitted via a flat cable 37 from a main substrate constituting a control unit not shown in the figures to the head control substrate of the recording head 21. Incidentally, the main substrate is disposed in the printer 10 at a front side thereof (a viewer side with respect to a drawing sheet of FIG. 2), and is not shown in FIG. 2. The flat cable 37 is shaped like a thin band in which a plurality of electric wires for transmitting electric signals are covered by a synthetic resin film, such as a polyester film, for an insulation of the electric wires. The flat cable 37 electrically connects the main substrate and the head control substrate to each other. The flat cable 37 has flexibility which allows the flat cable 37 to bend according to the reciprocation of the carriage 22.

Drive Switch Mechanism 40

The following is a description regarding the drive switch mechanism 40 which transmit the drive force from the motor to one or ones of a plurality of drive portions including the sheet supply roller 13, the purge mechanism 34, and other drive portions. The drive switch mechanism 40 is disposed in a right side of a frame (a right side in FIG. 2) constructed by the guide rails 23, 24 and so on, and is configured to transmit a driving outputted from the motor to one or ones of the drive portions.

Figure 3:
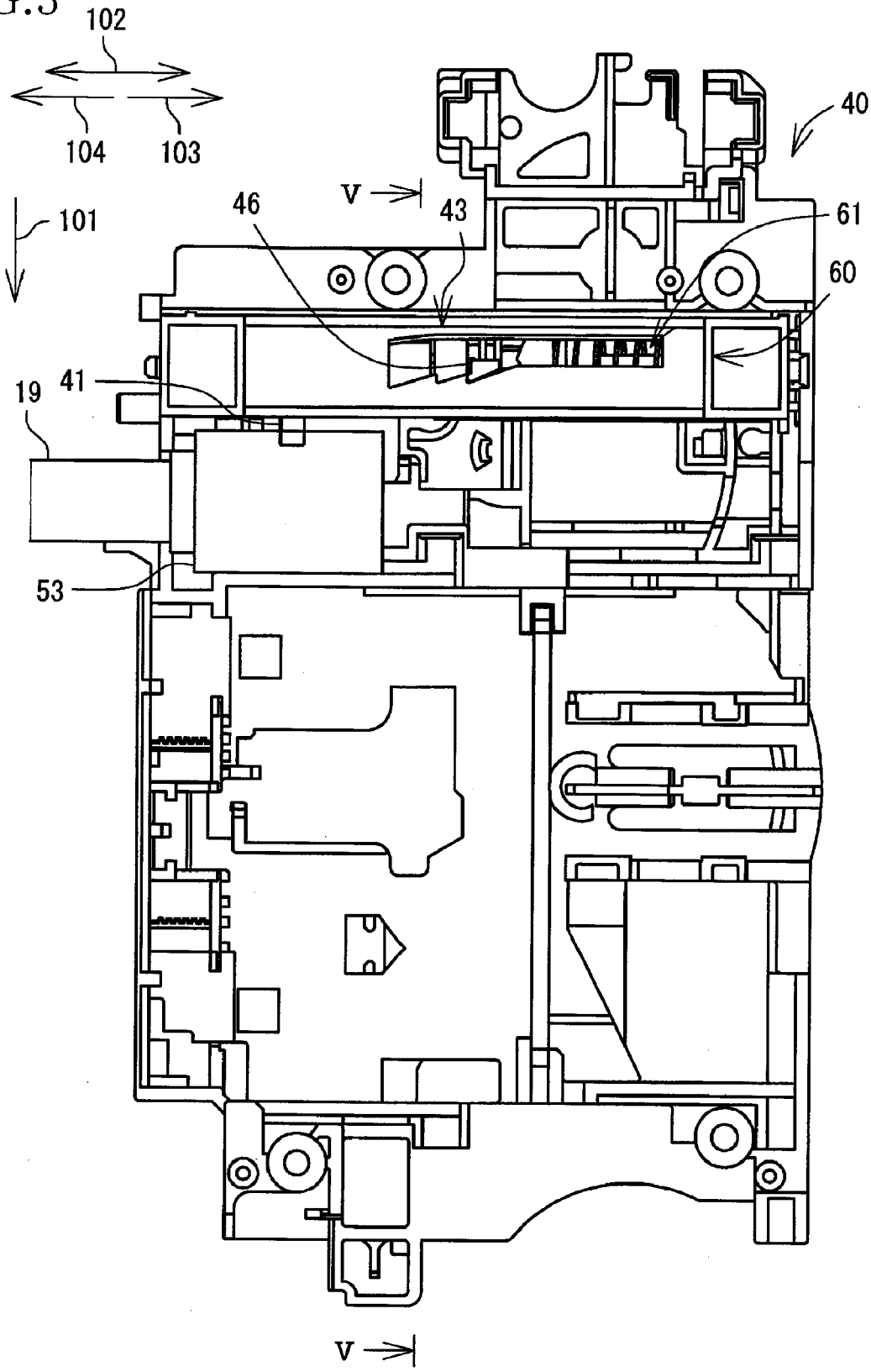
FIG. 3 is a plain view showing a constitution of a drive switch mechanism 40.

Though the motor is not depicted in the figures, an output of the motor is inputted into one end of a drive roller 19 of the conveyor roller pair 17. The one end is located in a left side of FIG. 3. As shown in FIG. 3, the other end of the drive roller 19 of the conveyor roller pair 17 is provided with a drive gear 53 (a first gear) which coaxially rotates together with the drive roller 19. The drive gear 53 meshes with a switch gear 41 (a second gear), which is rotatively driven on the basis of the output of the motor. The drive gear 53 is sufficiently wide with respect to a slide range of the switch gear 41, and thus the switch gear 41 and the drive gear 53 constantly meshes with each other in the slide range of the switch gear 41. An axis of the switch gear 41 is parallel to an axis of the drive gear 53, and both of the axes extend along the main scanning directions 102. The switch gear 41 is movable parallel to the drive gear 53.

Figure 4:
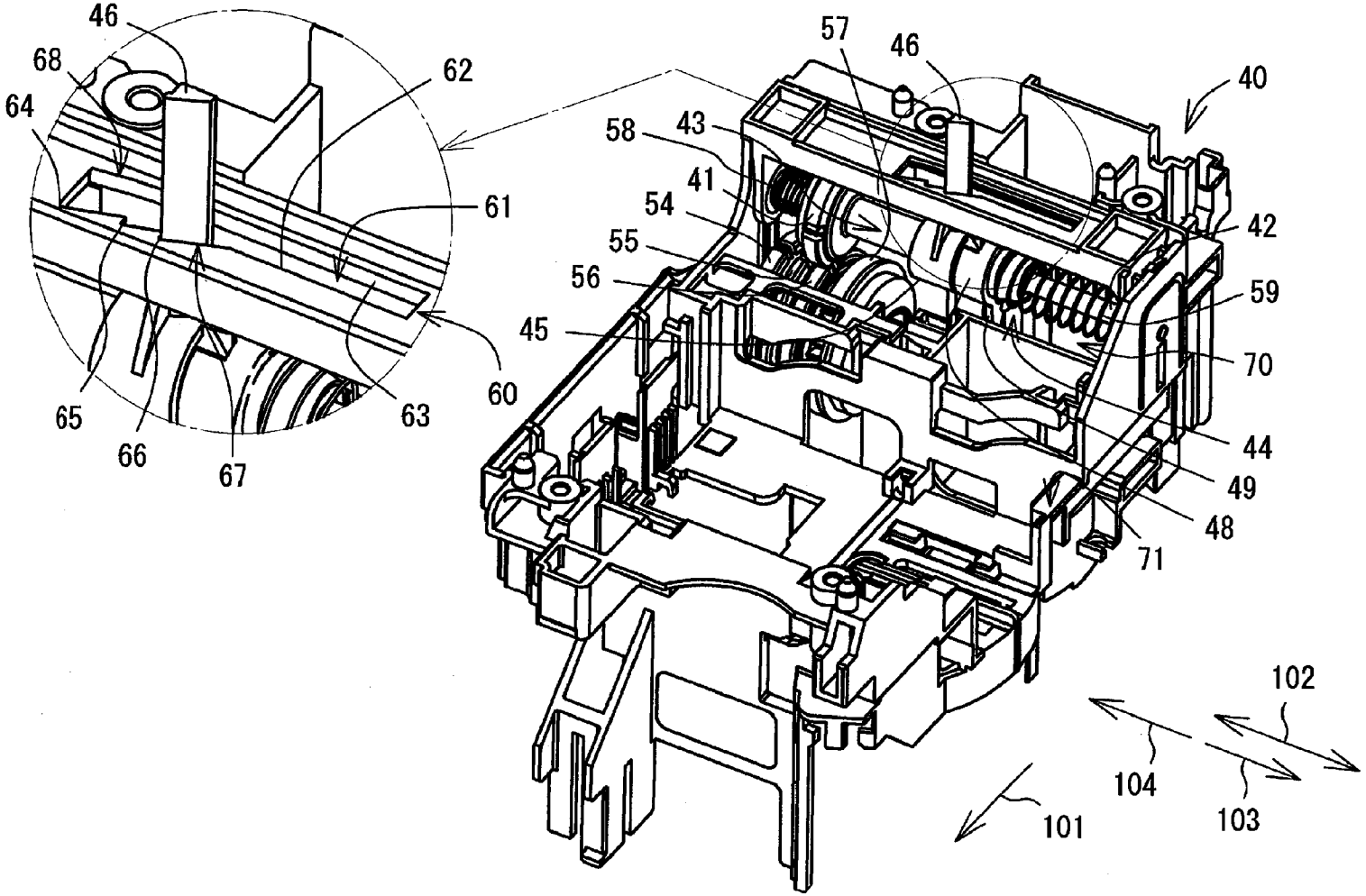
FIG. 4 is a perspective view showing the constitution of the drive switch mechanism 40.

As shown in FIG. 4, the switch gear 41 is slidably supported by a single support shaft 42 such that the switch gear 41 is allowed to slide in axis directions of the support shaft 42. The axis directions of the support shaft 42 extend along the main scanning directions 102. Below the support shaft 42, there is disposed another support shaft (not shown in FIG. 4) so as to be parallel to the support shaft 42. The another support shaft rotatively supports transmission gears 54, 55, 56, 57. The transmission gears 54, 55, 56, 57 are aligned side by side on the another support shaft. Each of the transmission gears 54, 55, 56, 57 is rotatable independently of each other. The switch gear 41 slides on the support shaft 42, whereby the switch gear 41 selectively meshes with one of the transmission gears 54, 55, 56, 57.

For example, the transmission gear 54 transmits the drive force of the motor to the sheet supply roller 13. The transmission gear 55 transmits the drive force of the motor to a lower sheet supply roller for supplying the sheet from a lower tray disposed below the sheet supply tray 11. The transmission gear 56 transmits the drive force of the motor to a re-conveyance roller disposed on a re-conveying path for returning the sheet to the recording device 15 subsequent to reversing the sheet on one surface of which an image had been recorded. The transmission gear 57 transmits the drive force of the motor to the purge mechanism 34. In this manner, the drive force of the motor is transmitted to each of the drive portions via each of the transmission gears 54, 55, 56, 57. It is to be appreciated that the aforementioned descriptions of the drive portions are just examples and all of the four transmission gears 54, 55, 56, 57 are not necessary to be provided in the drive switch mechanism 40. For example, if the printer 10 did not have the lower tray or the re-conveying path, spacers for disposing the transmission gears 54, 57 in place might be provided instead of the transmission gears 55, 56.

As shown in FIG. 4, each of a lever member 43 and a push switch member 44 is slidably provided on the support shaft 42 and in an outside of the switch gear 41 in a reciprocating directions of the carriage 22, that is, in a right side in the first direction 103 (in a right side in FIG. 3).

Figure 5:
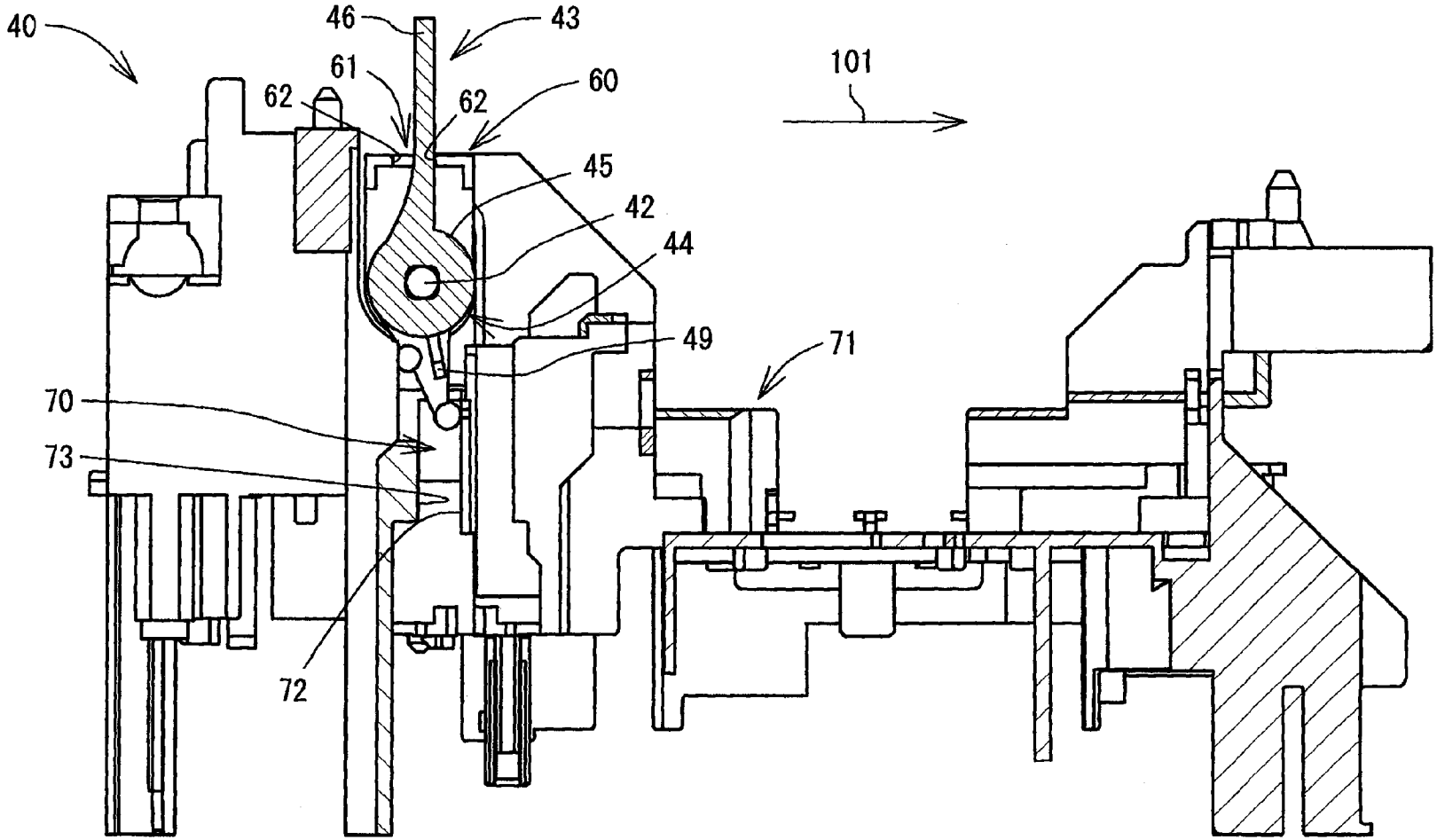
FIG. 5 is a cross-sectional view showing the drive switch mechanism 40 taken along a line IV-IV in FIG. 3.

As shown in FIGS. 3-5, the lever member 43 includes a hollow cylindrical member 45 fitted on an outside of the support shaft 42, and a lever arm 46 provided so as to radially protrude from the hollow cylindrical member 45. The hollow cylindrical member 45 is slidable in the axis directions of the support shaft 42 and rotatable with respect to the support shaft 42.

Therefore, the lever arm 46 is slidable in the axis directions of the support shaft 42 and rotatable around the support shaft 42. The hollow cylindrical member 45 extends along the axis directions of the support shaft 42, and thus one end of the hollow cylindrical member 45 is in contact with the switch gear 41 and the other end of the hollow cylindrical member 45 is in contact with the push switch member 44. The hollow cylindrical member 45 is provided with a rib 47 shown in FIG. 6, at an end of the hollow cylindrical member 45 nearer to the push switch member 44. The rib 47 extends in axis directions of the hollow cylindrical member 45.

As shown in FIGS. 4 and 5, the push switch member 44 includes a hollow cylindrical member 48 fitted on the outside of the support shaft 42, and a switch arm 49 provided so as to radially protrude from the hollow cylindrical member 48. The hollow cylindrical member 48 is slidable in the axis directions of the support shaft 42 and rotatable with respect to the support shaft 42. Therefore, the switch arm 49 is slidable in the axis directions of the support shaft 42 and rotatable around the support shaft 42. The hollow cylindrical member 48 extends in the axis directions of the support shaft 42, and thus one end of the hollow cylindrical member 48 is in contact with the lever member 43. The hollow cylindrical member 48 is provided with a recessed portion 50 shown in FIG. 6, at an end of the hollow cylindrical member 48 nearer to the lever member 43. The recessed portion 50 recesses in the axis directions of the support shaft 42.

As shown in FIG. 6, a first inclined portion 51 and a second inclined portion 52 are formed on respective end faces of the push switch member 44 so as to oppose to the recessed portion 50. That is, the end faces constituting the first inclined portion 51, the second inclined portion 52, and other faces of the push switch member 44 define the recessed portion 50. The first inclined portion 51 and the second inclined portion 52 form a shape like a mound protruding toward the lever member 43. Each of the first inclined portion 51 and the second inclined portion 52 is a plain face extending in radial directions of the support shaft 42, and are formed in series in circumferential directions of the support shaft 42. The rib 47 of the lever member 43 is inserted into the recessed portion 50, and an edge of the rib 47 selectively comes into abutting contact with one of the first inclined portion 51 and the second inclined portion 52.

As shown in FIG. 4, the switch gear 41 is elastically pushed toward the lever member 43 by a coil spring 58 (a first force applying portion) which is fitted on the outside of the support shaft 42. The coil spring 58 is elastic in the axis directions of the support shaft 42. The push switch member 44 is elastically pushed toward the lever member 43 by another coil spring 59 (a second force applying portion) which is fitted on the outside of the support shaft 42. The coil spring 59 is elastic in the axis directions of the support shaft 42. Hereinafter, a direction in which the switch gear 41 is pushed is referred to as a first direction 103, and a direction in which the push switch member 44 is pushed is referred to as a second direction 104. Accordingly, both of the switch gear 41 and the push switch member 44 are pushed toward the lever member 43 by the two respective coil springs 58, 59 which apply their respective forces toward respective directions opposite from each other. Consequently, the switch gear 41, the lever member 43, and the push switch member 44 are brought into abutting contact with each other and unite on the support shaft 42. The force of the coil spring 59 applied to the push switch member 44, namely, the force in the second direction 104 is larger than the force of the coil spring 58 applied to the switch gear 41, namely, the force in the first direction 103. Therefore, when an external force is not applied to the switch gear 41, the lever member 43, and the push switch member 44, they slidingly moves on the support shaft 42 in the second direction 104.

As shown in FIGS. 2-5, a lever guide 60 (a first guide member) is provided above the support shaft 42. The lever guide 60 is fitted into a hole formed in a part of the guide rail 23 nearer to the purge mechanism 34, thereby being fixed to the guide rail 23. The lever guide 60 is a plate-like member in which a long hole 61 being long in the main scanning directions 102 is formed. The lever arm 46 of the lever member 43 is inserted through long hole 61 so as to protrude upward from the guide rail 23. As described later, the switch arm 49 keeps a rotational posture of the push switch member 44 with respect to the support shaft 42 within a set range. The rib 47 of the lever member 43 comes into abutting contact with one of the first inclined portion 51 and the second inclined portion 52 of the recessed portion 50 of the push switch member 44 in accordance with a relative position of the lever member 43 to the push switch member 44.

The first inclined portion 51 is inclined such that, when the lever arm 46 pivots in the direction in which the lever arm 46 comes close to a first periphery portion 62 of the long hole 61, the push switch member 44 moves in a direction in which the push switch member 44 moves away from the lever member 43 in the main scanning directions 102. The second inclined portion 52 is inclined such that, when the lever arm 46 pivots in the direction in which the lever arm 46 comes close to a second periphery portion 63 of the long hole 61, the switch member 44 moves in the direction in which the switch member 44 moves away from the lever member 43 in the main scanning directions 102. In other words, the first inclined portion 51 extends such that, as a point on the first inclined portion 51 moves toward the first periphery portion 62 of the long hole 61, the point moves away from the lever member 43 in the axis directions of the support shaft 42, and the second inclined portion 52 extends such that, as a point on the second inclined portion 52 moves toward the second periphery portion 63 of the long hole 61, the point moves away from the lever member 43 in the axis directions of the support shaft 42.

When the rib 47 is in contact with the first inclined portion 51, the lever arm 46 is pushed to pivot toward the first periphery portion 62 of the long hole 61 relative to the push switch member 44. When the rib 47 is in contact with the second inclined portion 52, the lever arm 46 is pushed to pivot toward the second periphery portion 63 of the long hole 61 relative to the push switch member 44.

A first lock portion 64 is formed at an end of the first periphery portion 62 of the long hole 61 in the second direction 104, and a second lock portion 65 and a third lock portion 66 are formed next to the first lock portion 64 in this order along the first direction 103. Respective positions of the first lock portion 64, the second lock portion 65, and the third lock portion 66 correspond to respective positions of the transmission gears 54, 55, 56 each of which meshes with the switch gear 41. The second lock portion 65 and the third lock portion 66 each protrude toward an upstream side in the sheet conveyed direction 101 from the first periphery portion 62. The second lock portion 65 and the third lock portion 66 can lock the lever arm 46 pushed in the second direction 104, against the force of the coil spring 59, owing to the protrusions. That is, when the lever arm 46 is locked in the first lock portion 64, the switch gear 41 meshes with the transmission gear 54; when the lever arm 46 is locked in the second lock portion 65, the switch gear 41 meshes with the transmission gear 55; and when the lever arm 46 is locked in the third lock portion 66, the switch gear 41 meshes with the transmission gear 56. A face of the second lock portion 65 nearer to the first lock portion 64, that is, a face of the first periphery portion 62 between the first lock portion 64 and a protruding tip of the second lock portion 65 is an inclined face which extends such that a point on the inclined face moves toward the upstream side in the sheet conveyed direction 101 as the point moves in the first direction 103. Therefore, when the lever arm 46 moves in the first direction 103 while guided by the inclined face, the lever arm 46 can go over the protruding tip of second lock portion 65. Similarly, a face of the third lock portion 66 nearer to the first lock portion 64, that is, a face of the first periphery portion 62 between the second lock portion 65 and a protruding tip of the third lock portion 66 is an inclined face which extends such that a point on the inclined face moves toward the upstream side in the sheet conveyed direction 101 as the point moves in the first direction 103. Therefore, when the lever arm 46 moves in the first direction 103 while guided by the inclined face, the lever arm 46 can go over the protruding tip of the third lock portion 66.

A third inclined portion 67 is formed on a portion of the first periphery portion 62 of the long hole 61 nearer to the coil spring 59 than the third lock portion 66 in the main scanning directions 102. The third inclined portion 67 protrudes such that a point on the third inclined portion 67 moves toward the upstream side in the sheet conveyed direction 101 as the point moves in the first direction 103. The lever arm 46 sliding along the first periphery portion 62 in the first direction 103 is guided by the third inclined portion 67 in a direction in which the lever arm 46 comes close to the second periphery portion 63. A portion of the first periphery portion 62 nearer to the coil spring 59 than the third inclined portion 67 of the first periphery portion 62 in the main scanning directions 102 extends along the main scanning directions 102 while being nearer to the second periphery portion 63 than the first lock portion 64, the second lock portion 65, and the third lock portion 66.

A fourth inclined portion 68 is formed on a portion of the second periphery portion 63 of the long hole 61 which opposes to the first lock portion 64. That is, the fourth inclined portion 68 is formed on an end of the second periphery portion 63 in the second direction 104. The fourth inclined portion 68 protrudes such that a point on the fourth inclined portion 68 moves toward a downstream side in the sheet conveyed direction 101 as the point moves in the second direction 104. That is, the fourth inclined portion 68 is formed in a part of the second periphery portion 63 opposing to the first lock portion 64 and at least a part of the first periphery portion 62 which is positioned between the first lock portion 64 and the second lock portion 65 in the main scanning directions 102. Additionally, the fourth inclined portion 68 is not formed in a part of the second periphery portion 63 opposing to the second lock portion 65. In other words, a position in the main scanning directions 102 where the fourth inclined portion 68 is formed is a position nearer to the first lock portion 64 than the second lock portion 65 in the main scanning directions 102. The lever arm 46 sliding along the second periphery portion 63 in the second direction 104 is guided by the fourth inclined portion 68 in a direction in which the lever arm 46 comes close to the first periphery portion 62.

As shown in FIGS. 4 and 5, an arm guide 70 (an example of a second guide member) is provided below the support shaft 42. The arm guide 70 serves as a part of a frame 71 supporting the support shaft 42 and the lever guide 60. The arm guide 70 is a member which defines a groove extending along the main scanning directions 102 and opening upward. A tip part of the switch arm 49 of the push switch member 44 is inserted into the groove defined by the arm guide 70.

The arm guide 70 is configured to define the groove being long in the main scanning directions 102 by a third periphery portion 72 being in the downstream side of the groove in the sheet conveyed direction 101 and a fourth periphery portion 73 being in the upstream side of the groove in the sheet conveyed direction 101. The tip part of the switch arm 49 of the push switch member 44 selectively comes into abutting contact with the third periphery portion 72 and the fourth periphery portion 73, whereby the push switch member 44 slidingly moves in the axis directions of the support shaft 42 while being kept within a predetermined pivoting range defined with respect to the circumferential directions of the support shaft 42. That is, the push switch member 44 is slidably guided by the arm guide 70 in the axis directions of the support shaft 42, while the push switch member 44 is rotatable from a position in which the push switch member 44 comes into contact with the third periphery portion 72 to a position in which the push switch member 44 comes into contact with the fourth periphery portion 73.

As shown in FIGS. 6-9, an inner surface of the third periphery portion 72 extends approximately along the main scanning directions 102, and a fifth inclined portion 74 is formed at a position corresponding to the third inclined portion 67 of the lever guide 60. The fifth inclined portion 74 protrudes such that a point on the fifth inclined portion 74 moves toward the upstream side in the sheet conveyed direction 101 as the point moves in the first direction 103. A movement of the switch arm 49 along the fifth inclined portion 74 in the first direction 103 rotates the push switch member 44 around the support shaft 42 so as to move the rib 47 of the lever member 43 in contact with the first inclined portion 51 of the push switch member 44, toward the second inclined portion 52.

An inner surface of the fourth periphery portion 73 extends approximately along the main scanning directions 102, and a sixth inclined portion 75 is formed in such a manner as to extend in the first direction 103 from a position corresponding to at least the first lock portion 64 of the lever guide 60. The sixth inclined portion 75 protrudes such that a point on the sixth inclined portion 75 moves toward the downstream side in the sheet conveyed direction 101 as the point moves in the second direction 104. A movement of the switch arm 49 along the sixth inclined portion 75 in the second direction 104 rotates the push switch member 44 around the support shaft 42 so as to move the rib 47 of the lever member 43 in contact with the second inclined portion 52 of the push switch member 44 toward the first inclined portion 51.

An angle of the third inclined portion 67 of the lever guide 60 relative to the main scanning directions 102 is smaller than an angle of the fifth inclined portion 74 relative to the main scanning directions 102, and an angle of the fourth inclined portion 68 of the lever guide 60 relative to the main scanning directions 102 is smaller than an angle of the sixth inclined portion 75 relative to the main scanning directions 102. Therefore, a pivoting amount of the lever member 43 which pivots around the support shaft 42 due to the third inclined portion 67 is smaller than a pivoting amount of the push switch member 44 which pivots around the support shaft 42 due to the fifth inclined portion 74, and a pivoting amount of the lever member 43 which pivots around the support shaft 42 due to the fourth inclined portion 68 is smaller than a pivoting amount of the push switch member 44 which pivots around the support shaft 42 due to the sixth inclined portion 75.

As shown in FIG. 2, an upstream edge of the carriage 22 in the sheet conveyed direction 101 is provided with a guide piece 38 protruding the upstream side in the sheet conveyed direction 101. The guide piece 38 reciprocates together with the carriage 22. Since the guide piece 38 moves together with the carriage 22, the guide piece 38 comes into abutting contact with the lever arm 46 of the lever member 43, and the lever arm 46 is moved in the first direction 103.

Drive Switching by Drive Switch Mechanism 40

The following is a description regarding a drive switching performed by a slide of the switch gear 41 with respect to each of transmission gears 54, 55, 56, 57.

Figure 6B:
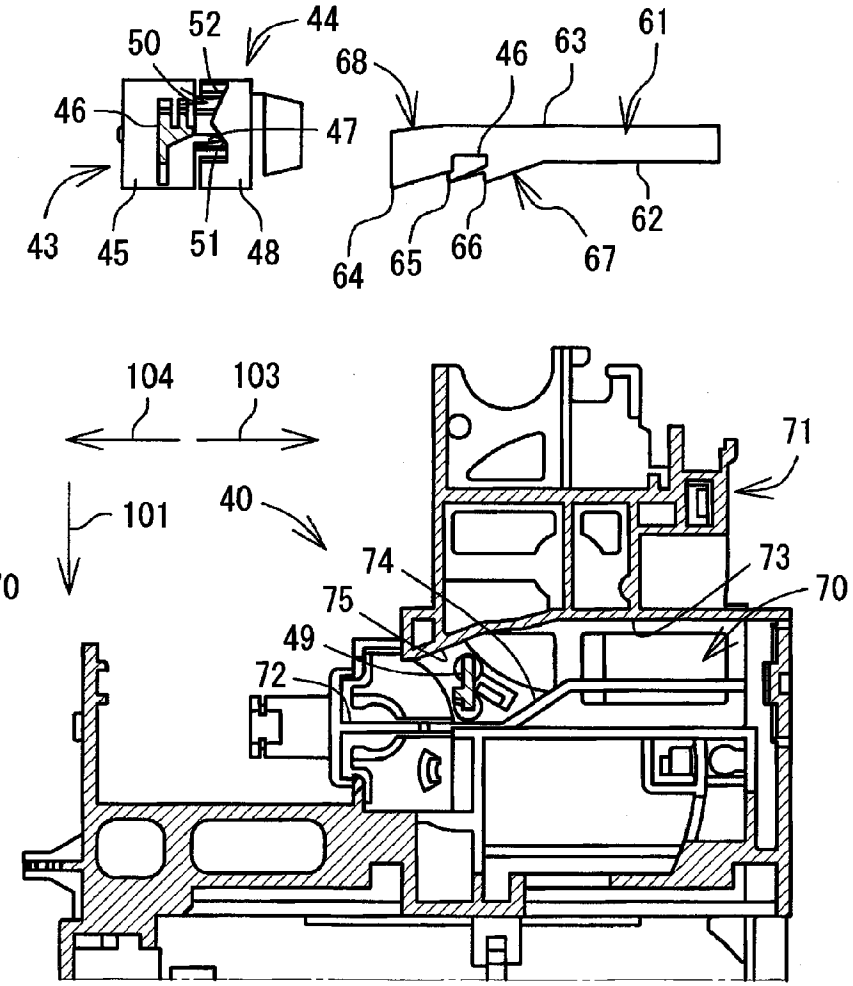
FIGS. 6A and 6B are schematic views for illustrating an operation of the drive switch mechanism 40.
Figure 6A:
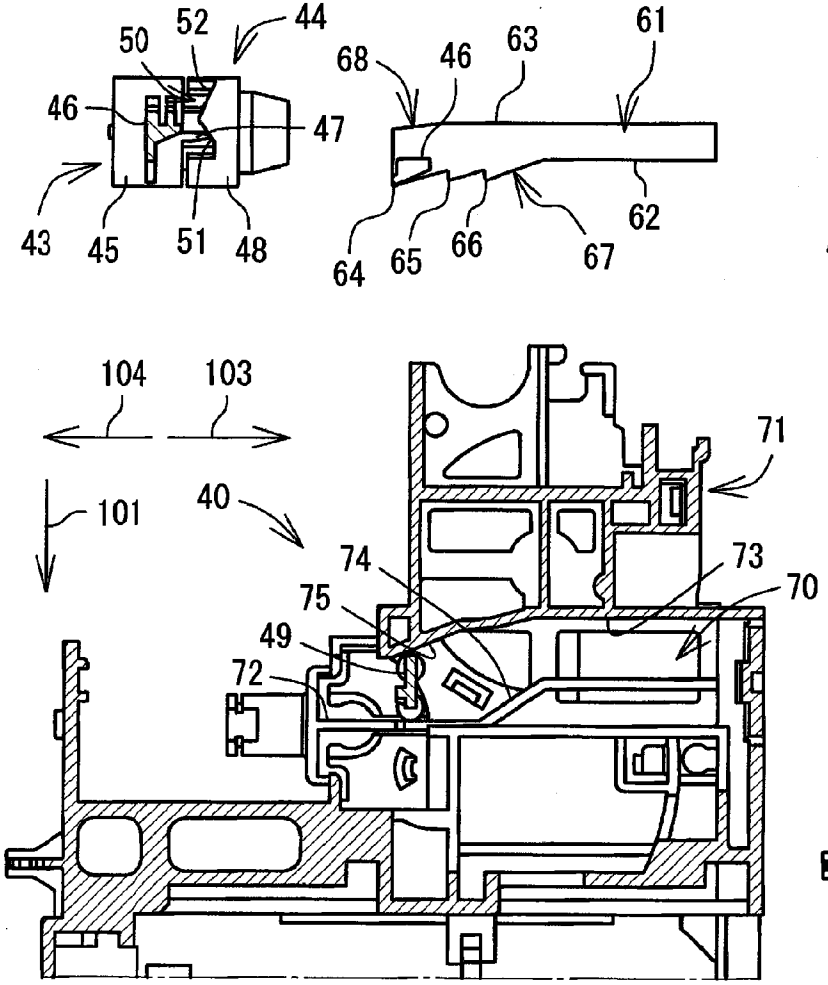

As shown in FIG. 6A, when the lever arm 46 is locked in the first lock portion 64 of the lever guide 60, the tip of the switch arm 49 of the push switch member 44 is in contact with a part of the third periphery portion 72 of the arm guide 70 being in a downstream side of the fifth inclined portion 74 in the second direction 104. In this state, since the rib 47 of the lever member 43 is in contact with the first inclined portion 51 of the push switch member 44, and the lever member 43 and the push switch member 44 are pushed by the two coil springs 58, 59 to come into abutting contact with each other, the lever arm 46 of the lever member 43 is pushed toward the first periphery portion 62 of the lever guide 60. Therefore, the lever arm 46 is kept in a locked state in the first lock portion 64. When the lever member 43 is in this position, the switch gear 41 is kept in the most upstream position in the first direction 103 and meshes with the transmission gear 54 corresponding to this position.

When the guide piece 38 of the carriage 22 comes into abutting contact with the lever arm 46 and moves in the first direction 103 from the position shown in FIG. 6A, the lever arm 46 moves from the first lock portion 64 to the second lock portion 65. As shown in FIG. 6B, when the lever arm 46 is locked in the second lock portion 65, the tip of the switch arm 49 of the push switch member 44 in contact with a part of the third periphery portion 72 of the arm guide 70 being in the downstream side of the fifth inclined portion 74 in the second direction 104. In this state, since the rib 47 of the lever member 43 is in contact with the first inclined portion 51 of the push switch member 44, and the lever member 43 and the push switch member 44 are pushed by the two coil springs 58, 59 to come into abutting contact with each other, the lever arm 46 of the lever member 43 is pushed toward the first periphery portion 62 of the lever guide 60. Therefore, the lever arm 46 is kept in a locked state in the second lock portion 65. When the lever member 43 is in this position, the switch gear 41 is kept in the second most upstream position in the first direction 103 and meshes with the transmission gear 55 corresponding to this position.

Figure 7B:
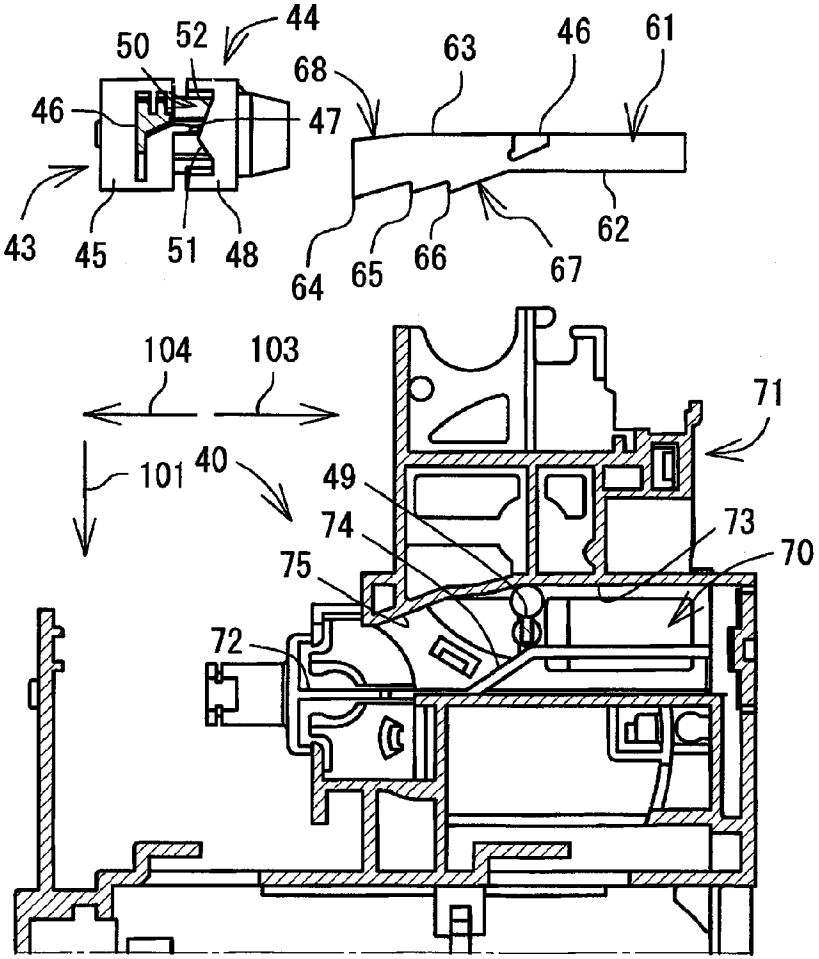
FIGS. 7A and 7B are schematic views for illustrating an operation of the drive switch mechanism 40.
Figure 7A:
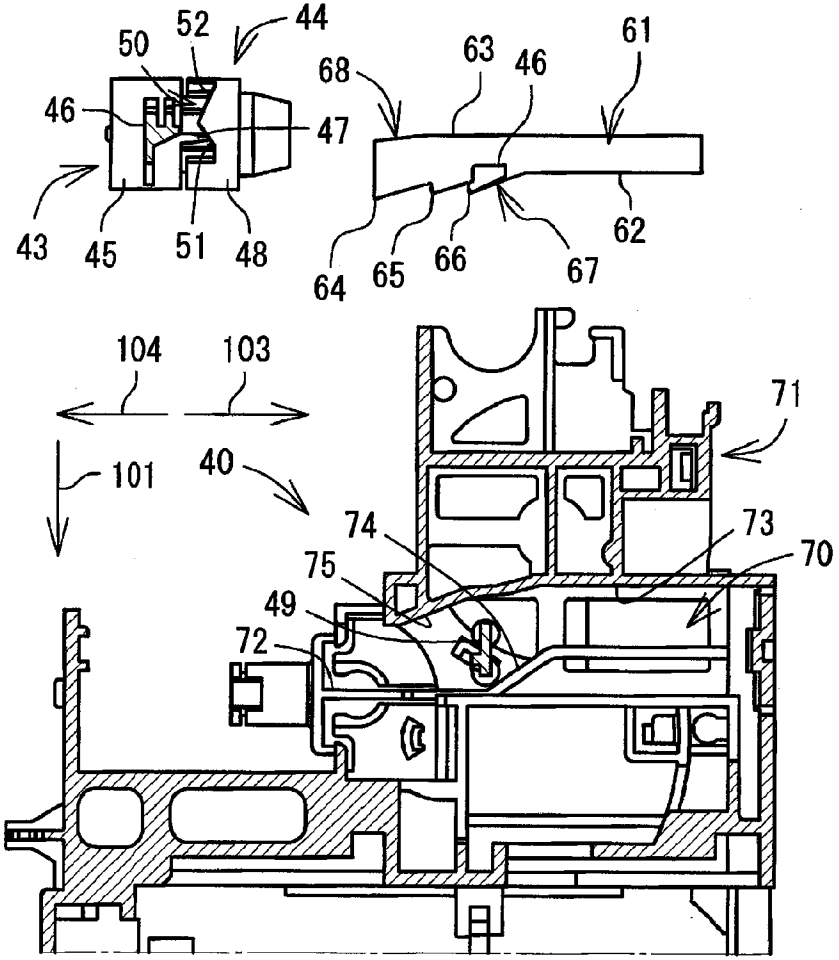

When the guide piece 38 of the carriage 22 comes into abutting contact with the lever arm 46 and moves in the first direction 103 from the position shown in FIG. 6B, the lever arm 46 moves from the second lock portion 65 to the third lock portion 66. As shown in FIG. 7A, when the lever arm 46 is locked in the third lock portion 66, the tip of the switch arm 49 of the push switch member 44 is in contact with a part of the third periphery portion 72 of the arm guide 70 being approximately in a downstream end of the fifth inclined portion 74 in the second direction 104. In this state, since the rib 47 of the lever member 43 is in contact with the first inclined portion 51 of the push switch member 44, and the lever member 43 and the push switch member 44 are pushed by the two coil springs 58, 59 to come into abutting contact with each other, the lever arm 46 of the lever member 43 is pushed toward the first periphery portion 62 of the lever guide 60. Therefore, the lever arm 46 is kept in a locked state in the third lock portion 66. When the lever member 43 is in this position, the switch gear 41 is kept in the third most upstream position in the first direction 103 and meshes with the transmission gear 56 corresponding to this position.

When the guide piece 38 of the carriage 22 comes into abutting contact with the lever arm 46 and moves in the first direction 103 from the position shown in FIG. 7A, the lever arm 46 further moves in the first direction 103 from the third lock portion 66. As shown in FIG. 7B, the lever arm 46 moves along the third inclined portion 67 on a process in which the lever arm 46 moves in the first direction 103 from the third lock portion 66. In addition, the tip of the switch arm 49 of the push switch member 44 moves along the fifth inclined portion 74 of the third periphery portion 72 of the arm guide 70. Therefore, the lever member 43 and the push switch member 44 pivot in respective directions opposite to each other, and the rib 47 of the lever member 43 moves from the first inclined portion 51 of the push switch member 44 to the second inclined portion 52 of the push switch member 44. That is, when the lever arm 46 of the lever member 43 slides on the third inclined portion 67 and the lever member 43 is guided by the third inclined portion 67 in a direction in which the lever arm 46 comes close to the second periphery portion 63, the switch arm 49 of the push switch member 44 slides on the fifth inclined portion 74 and the push switch member 44 is pivoted by the fifth inclined portion 74 in a direction in which the rib 47 of the lever member 43 comes close to the second inclined portion 52. Since the lever member 43 and the push switch member 44 are pushed by the two coil springs 58, 59 to come into abutting contact with each other, the lever arm 46 of the lever member 43 is pushed toward the second periphery portion 63 of the lever guide 60. Incidentally, a duration in which the lever member 43 is guided by the third inclined portion 67 in the direction in which the lever arm 46 comes close to the second periphery portion 63 and a duration in which the push switch member 44 is pivoted by the fifth inclined portion 74 in the direction in which the rib 47 of the lever member 43 comes close to the second inclined portion 52 may overlap with each other as described above, or may be identical with each other.

Figure 8B:
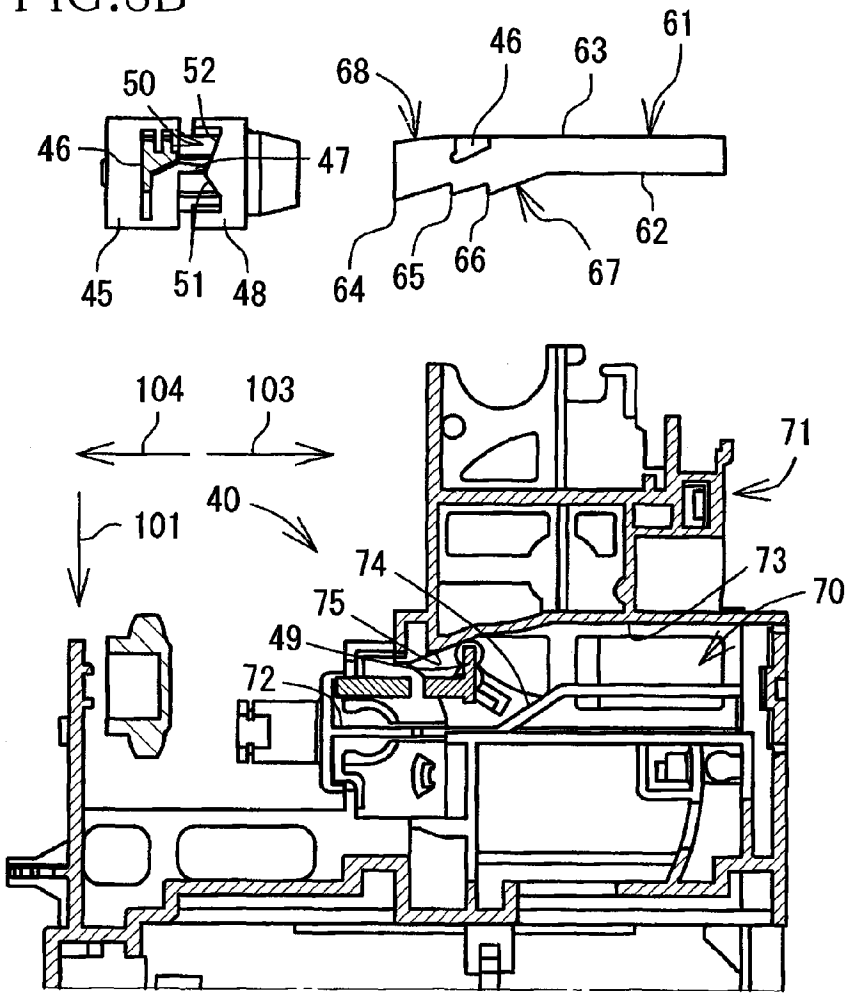
FIGS. 8A and 8B are schematic views for illustrating an operation of the drive switch mechanism 40.
Figure 8A:
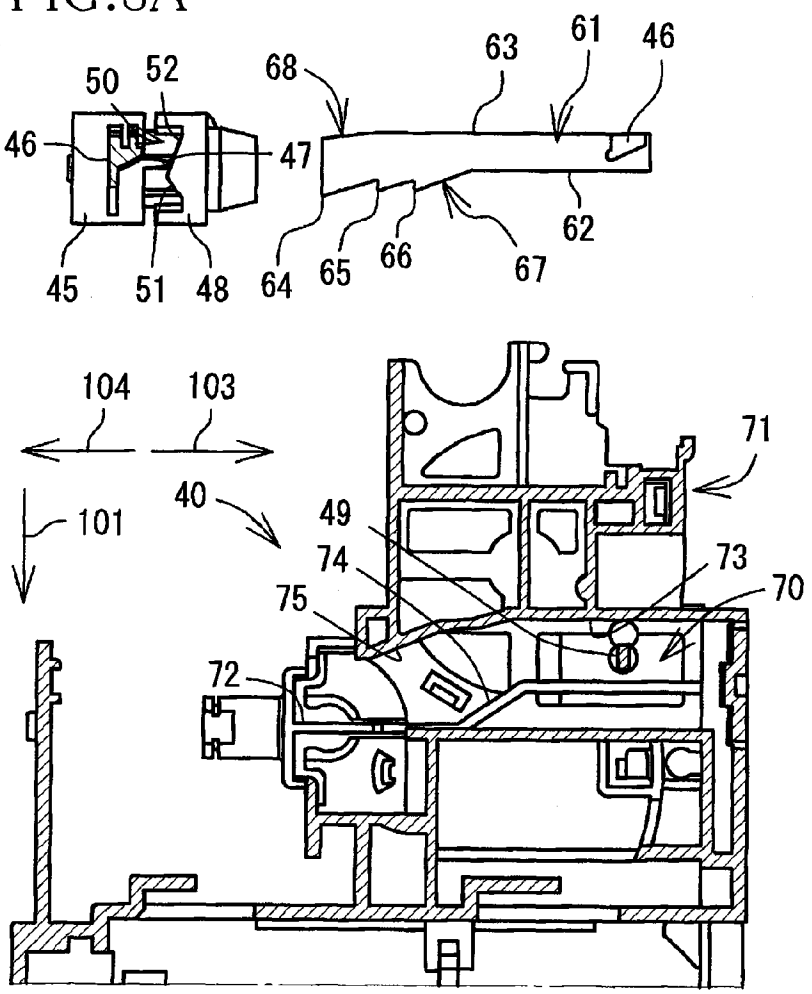

As shown in FIG. 8A, when the lever arm 46 moves further in the first direction 103, the lever arm 46 reaches to the most downstream position of the lever guide 60. A position of the carriage 22 in this state is a position in which the recording head 21 is covered with the cap 36. When the lever member 43 is in this position, the switch gear 41 is kept in the most downstream position in the first direction 103 and meshes with the transmission gear 57 corresponding to this position.

By the way, when the switch gear 41 is moved from the position in which the switch gear 41 meshes with one of the transmission gears 54, 55, 56, 57, a contact pressure between the transmission gear and the one of the transmission gears 54, 55, 56, 57 is released, for example, by a control for rotating the switch gear 41 slightly backward relative to a forward (normal) rotation. Then, in order to adjust a phase of the switch gear 41 to a phase of a next one of the transmission gears 54, 55, 56, 57, slight forward and backward rotations of the switch gear 41 are alternately repeated. These alternate rotations cause the phase of the switch gear 41 to be adjusted to the phase of the next one of the transmission gears 54, 55, 56, 57. Therefore, the switch gear 41 slides on the support shaft 42 by the elastic force of the coil spring 58 and separates away from the one of the transmission gears 54, 55, 56, 57, and then meshes with the next one of the transmission gears 54, 55, 56, 57.

Figure 9:
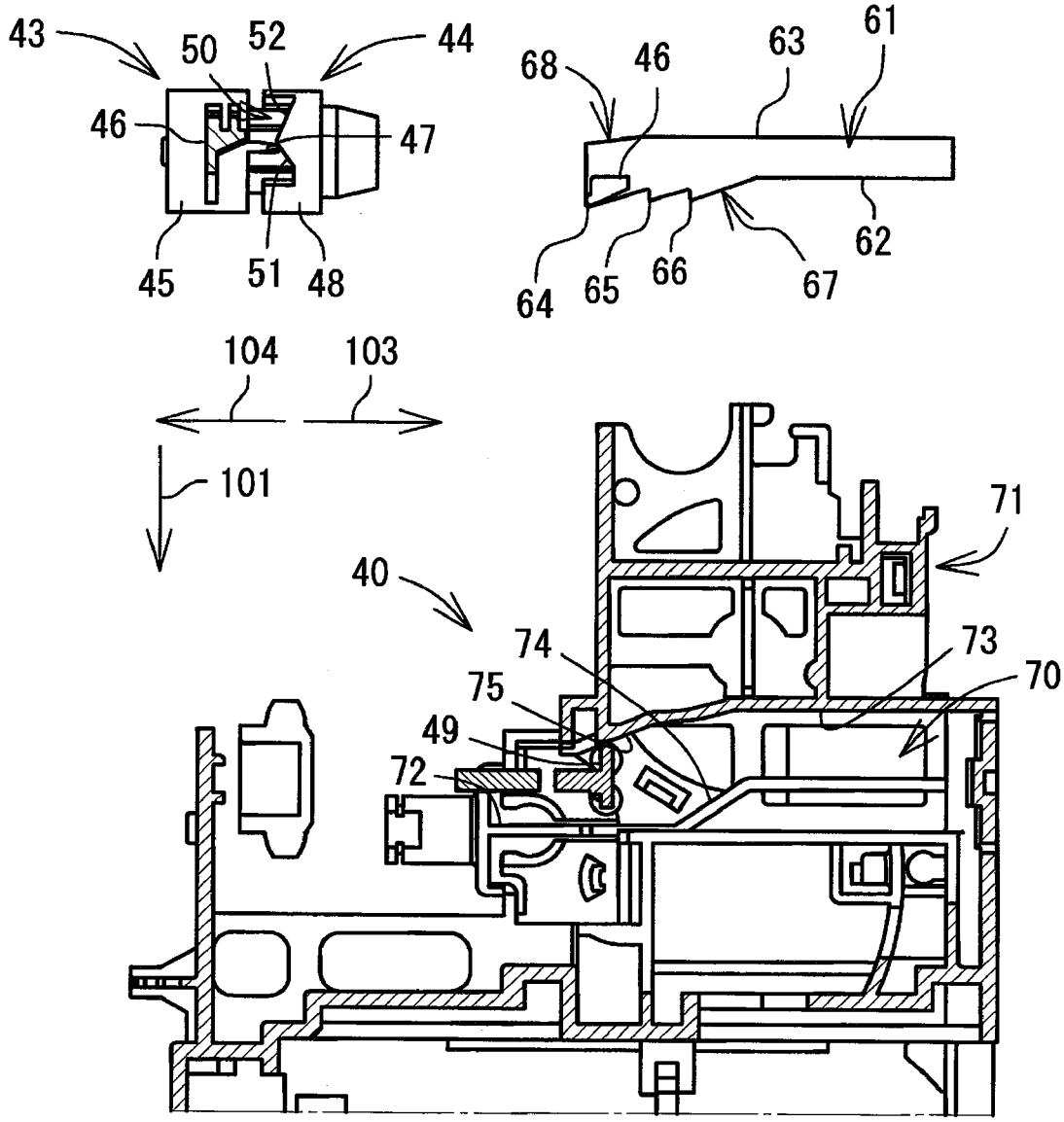
FIG. 9 is a schematic view for illustrating an operation of the drive switch mechanism 40.

When the carriage 22 moves from the position shown in FIG. 8A in the second direction 104, the guide piece 38 separates away from the lever arm 46. Owing to the separation of the guide piece 38, the lever member 43 is pushed by the coil springs 58, 59 in the second direction 104. As shown in FIG. 8B, the tip of the switch arm 49 of the push switch member 44 reaches to the sixth inclined portion 75 of the fourth periphery portion 73 of the arm guide 70 and moves along the sixth inclined portion 75 on a process in which the lever arm 46 moves in the second direction 104 and along the second periphery portion 63 from the most downstream position in the first direction 103. In addition, when the lever arm 46 comes close to a downstream position in the second direction 104, the lever arm 46 moves along the fourth inclined portion 68 of the second periphery portion 63. Therefore, as shown in FIG. 9, the lever member 43 and the push switch member 44 pivot in respective directions opposite to each other, and the rib 47 of the lever member 43 moves from the first inclined portion 52 of the push switch member 44 to the second inclined portion 51 of the push switch member 44. That is, when the lever arm 46 of the lever member 43 slides on the fourth inclined portion 68 and the lever member 43 is guided by the fourth inclined portion 68 in a direction in which the lever arm 46 comes close to the first periphery portion 62, the switch arm 49 of the push switch member 44 slides on the sixth inclined portion 75 and the push switch member 44 is pivoted by the sixth inclined portion 75 in a direction in which the rib 47 of the lever member 43 comes close to the first inclined portion 51. Since the lever member 43 and the push switch member 44 are pushed by the two coil springs 58, 59 to come into abutting contact with each other, the lever arm 46 of the lever member 43 is pushed toward the first periphery portion 62 of the lever guide 60. Then, the lever arm 46 is locked in the first lock portion 64 of the lever guide 60, as shown in FIG. 6A. Incidentally, a duration in which the lever member 43 is guided by the fourth inclined portion 68 in the direction in which the lever arm 46 comes close to the first periphery portion 62 and a duration in which the push switch member 44 is pivoted by the sixth inclined portion 75 in the direction in which the rib 47 of the lever member 43 comes close to the second inclined portion 51 may overlap with each other as described above, or may be identical with each other.

Working Effect of The Embodiment

According to the embodiment, since the lever arm 46 of the lever member 43 is selectively pushed by the push switch member 44 to the first periphery portion 62 and the second periphery portion 63, the lever arm 46 can be smoothly and surely slid to a desired lock position.

Additionally, relative positions of the lever member 43 and the push switch member 44 are changed by not only the lever guide 60 but the arm guide 70. Therefore, it is possible to reduce a slide amount of the lever member 43 in the main scanning directions 102 which is necessary for a switch of the force by the push switch member 44.

In addition, since the pivoting amount of the lever member 43 which pivots around the support shaft 42 due to the third inclined portion 67 is smaller than the pivoting amount of the push switch member 44 which pivots around the support shaft 42 due to the fifth inclined portion 74, and since the pivoting amount of the lever member 43 which pivots around the support shaft 42 due to the fourth inclined portion 68 is smaller than the pivoting amount of the push switch member 44 which pivots around the support shaft 42 due to the sixth inclined portion 75, the angles of the third inclined portion 67 and the fourth inclined portion 68 relative to the main scanning directions 102 are relatively small, and thus a load against the carriage 22 in the sheet conveyed direction 101 can be reduced.

Modified Embodiment

Figure 10B:
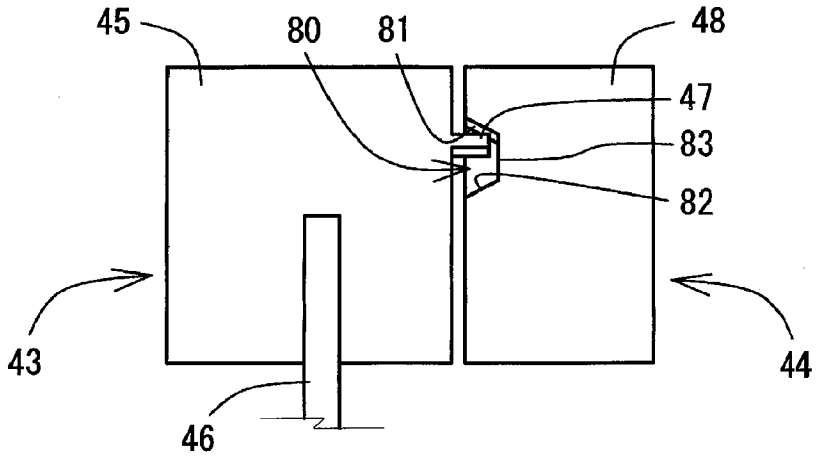
FIGS. 10A-10C are schematic views showing a recessed portion 80 in a modified embodiment according to the present invention.
Figure 10C:
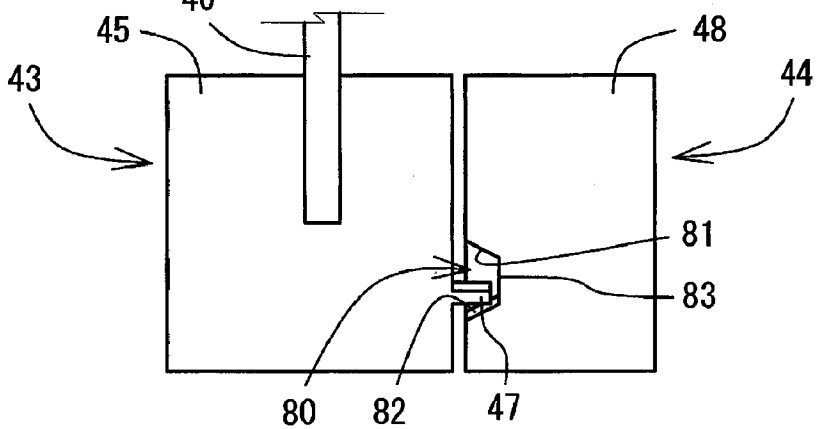
Figure 10A:
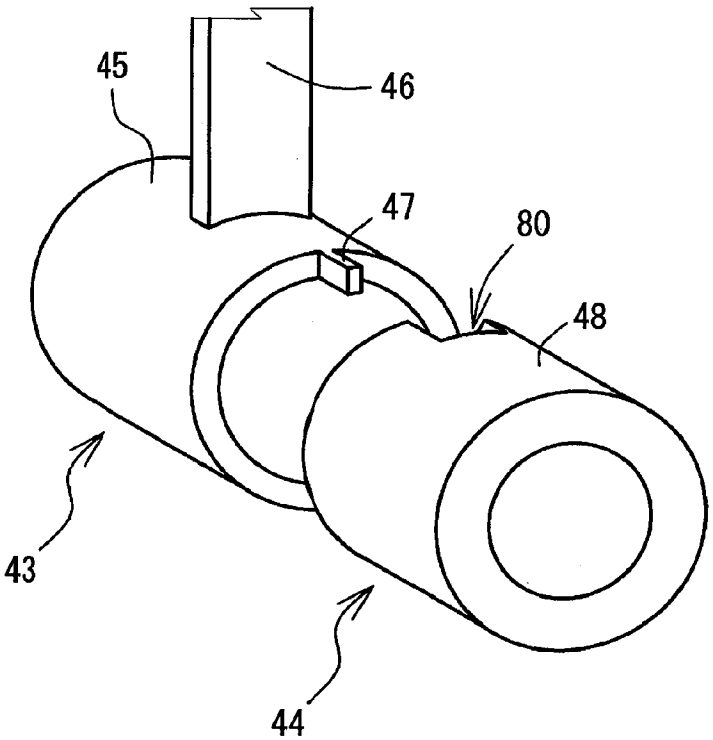

In the aforementioned embodiment, the recessed portion 50 having the first inclined portion 51 and the second inclined portion 52 on the end face thereof is formed in the push switch member 44, and the inclined portions 51, 52 form a shape like a mound protruding toward the lever member 43. Alternatively, as shown in FIG. 10, the push switch member 44 may be provided with a recessed portion 80 which is recessed in the axis directions of the support shaft 42 and is shaped like a trapezoid being wider at a side nearer to the lever member 43. In this case, a first inclined portion 81 and a second inclined portion 82 may be formed on both sides of the recessed portion 80 in the circumferential directions of the support shaft 42. The first inclined portion 81 and the second inclined portion 82 are each a plain face extending in radial directions of the support shaft 42, and are formed continuously via a plain face extending along the radial directions and the circumferential directions of the support shaft 42.

In a similar way to the aforementioned embodiment, for example, relative pivoting positions of the lever member 43 and the push switch member 44 around the support shaft 42 are changed according to a position in which the switch arm 49 of the push switch member 44 is in contact with the arm guide 70, whereby the rib 47 of the lever member 43 can be selectively come into abutting contact with one of a first inclined portion 81 and a second inclined portion 82. Since the rib 47 of the lever member 43 is in contact with the first inclined portion 81 of the push switch member 44, and since the lever member 43 and the push switch member 44 are pushed by the two coil springs 58, 59 to come into abutting contact with each other, the lever arm 46 of the lever member 43 is pushed toward the first periphery portion 62 of the lever guide 60. Since the rib 47 of the lever member 43 is in contact with the second inclined portion 82 of the push switch member 44, and since the lever member 43 and the push switch member 44 are pushed by the two coil springs 58, 59 to come into abutting contact with each other, the lever arm 46 of the lever member 43 is pushed toward the second periphery portion 63 of the lever guide 60. The modified embodiment like this also provides the same working effects as the aforementioned embodiment.

In the aforementioned embodiment and the modified embodiment, the three lock portions are provided in the drive switch mechanism 40. However, it is to be appreciated to those skilled in the art that the number of positions for transmitting the driving may be increased or decreased within the scope and the spirit of the present invention.

What is claimed is:

1. A record image recording apparatus comprising:

a carriage on which a recording head is mounted, configured to reciprocate in main scanning directions;

a first gear configured to rotate around a rotation axis of the first gear extending along the main scanning directions on the basis of an output of a driving motor;

a second gear meshed with the first gear and slidably supported by a support shaft extending along the main scanning directions, the second gear being movable at a plurality of slide positions;

a plurality of transmission gears arranged in parallel, each of which is meshable with the second gear at a corresponding one of the plurality of slide positions of the second gear;

a lever member slidably supported by the support shaft and pivotably supported around the support shaft, the lever member being disposed in one of opposite side regions of the second gear in a first direction which is one direction of the main scanning directions, the lever member comprising a lever arm protruding into a moving space through which the carriage moves;

a switch member slidably supported by the support shaft and disposed in the one of the opposite side regions in which the lever member is disposed, the switch member having a first inclined portion and a second inclined portion each contactable with a contact portion of the lever member;

a first force applying portion configured to apply a force in the first direction to the second gear such that the force is applied from the second gear to the lever member;

a second force applying portion configured to apply a force larger than the force applied by the first force applying portion to the switch member, in a second direction which is opposite to the first direction so that the switch member comes into contact with the lever member;

a first guide member configured to guide the lever arm while the lever arm slides on the first guide member in the main scanning directions, and configured to position the lever arm at selectively one of a plurality of slide positions of the lever arm, the plurality of slide positions of the lever arm corresponding to the respective positions of the plurality of transmission gears; and a second guide member configured to restrict a circumferential rotation of the switch member with respect to the support shaft, wherein the first guide member is provided with a plurality of peripheries including a first periphery and a second periphery each extending along the main scanning directions, the plurality of peripheries defining a long hole through which the lever arm is inserted, wherein the first periphery is provided with: a plurality of lock portions which lock the lever arm to which the force in the second direction is applied; and a third inclined portion which causes the lever arm to pivot in a direction in which the lever arm comes close to the second periphery, wherein the third inclined portion is positioned at a part of the first periphery nearer to the second force applying portion than the lock portions in the main scanning directions, wherein the second periphery is provided with a fourth inclined portion which causes the lever arm to pivot in a direction in which the lever arm comes close to the first periphery, wherein the fourth inclined portion is positioned at a part of the second periphery opposing to one of the plurality of lock portions nearest to the first force applying portion in the main scanning directions, wherein the lever member is guided by the third inclined portion in the direction in which the lever arm comes close to the second periphery so that a contact position of the switch member in contact with the contact portion of the lever member moves from on the first inclined portion to on the second inclined portion, whereby the switch member is configured to cause a switch from a state in which the lever member is applied with a force from the switch member in the direction in which the lever arm comes close to the first periphery to a state in which the lever member is applied with a force from the switch member in the direction in which the lever arm comes close to the second periphery, and wherein the lever member is guided by the fourth inclined portion in the direction in which the lever arm comes close to the first periphery so that the contact position of the switch member in contact with the contact portion of the lever member moves from on the second inclined portion to on the first inclined portion, whereby the switch member is configured to cause a switch from a state in which the lever member is applied with the force from the switch member in the direction in which the lever arm comes close to the second periphery to a state in which the lever member is applied with the force from the switch member in the direction in which the lever arm comes close to the first periphery.

2. The image recording apparatus according to claim 1, wherein the first inclined portion is inclined such that, when the lever arm pivots in the direction in which the lever arm comes close to the first periphery, the switch member moves in a direction in which the switch member moves away from the lever member in the main scanning directions, and wherein the second inclined portion is inclined such that, when the lever arm pivots in the direction in which the lever arm comes close to the second periphery, the switch member moves in a direction in which the switch member moves away from the lever member in the main scanning directions.

3. The image recording apparatus according to claim 2, wherein the switch member comprises a series of the first inclined portion, the second inclined portion, and an end portion of the switch member nearest to the lever member.

4. The image recording apparatus according to claim 1, wherein the switch member comprises a switch arm pivotably supported about the support shaft and protruding in a radial directions of the support shaft, wherein the second guide member is provided with a plurality of peripheries including a third periphery and a fourth periphery each extending along the main scanning directions, the plurality of peripheries defining a long groove through which the switch arm is inserted, whereby the second guide member restricts a circumferential rotation of the switch member with respect to the support shaft within a predetermined range, wherein the third periphery is provided with a fifth inclined portion configured to cause the switch arm to slide on the fifth inclined portion so as to cause the switch member to pivot in a direction in which the contact portion of the lever member in contact with the first inclined portion comes close to the second inclined portion, and wherein the fourth periphery is provided with a sixth inclined portion configured to cause the switch arm to slide on the sixth inclined portion so as to cause the switch member to pivot in a direction in which the contact portion of the lever member in contact with the second inclined portion comes close to the first inclined portion.

5. The image recording apparatus according to claim 4, wherein (i) a duration in which the lever member is guided by the third inclined portion in the direction in which the lever arm comes close to the second periphery and (ii) a duration in which the fifth inclined portion causes the switch member to pivot in the direction in which the contact portion of the lever member comes close to the second inclined portion overlap with each other or are identical with each other.

6. The image recording apparatus according to claim 4, wherein (i) a duration in which the lever member is guided by the fourth inclined portion in the direction in which the lever arm comes close to the first periphery and (ii) a duration in which the sixth inclined portion causes the switch member to pivot in the direction in which the contact portion of the lever member comes close to the first inclined portion overlap with each other or are identical with each other.

7. The image recording apparatus according to claim 4, wherein a pivoting amount of the switch member with respect to the support shaft in the pivoting caused by the fifth inclined portion is larger than a pivoting amount of the lever member with respect to the support shaft in the pivoting caused by the third inclined portion.

8. The image recording apparatus according to claim 4, wherein a pivoting amount of the switch member with respect to the support shaft in the pivoting caused by the sixth inclined portion is larger than a pivoting amount of the lever member with respect to the support shaft in the pivoting caused by the fourth inclined portion.

* * * * *